US006003600A

United States Patent [19]

Nguyen et al.

[11] Patent Number: 6,003,600

[45] Date of Patent: Dec. 21, 1999

[54] METHODS OF COMPLETING WELLS IN UNCONSOLIDATED SUBTERRANEAN ZONES

[75] Inventors: Philip D. Nguyen, Duncan, Okla.; Ronald G. Dusterhoft, Katy, Tex.

[73] Assignee: Halliburton Energy Services, Inc., Duncan, Okla.

[21] Appl. No.: 08/951,936

[22] Filed: Oct. 16, 1997

[51] Int. Cl.[6] ..... E21B 33/13

[52] U.S. Cl. ..... 166/281; 166/295

[58] Field of Search ..... 166/276, 278, 166/51, 281, 227, 295, 236

[56] References Cited

U.S. PATENT DOCUMENTS

| | | | |
|---|---|---|---|
| 3,670,817 | 6/1972 | Saucier | 166/252.1 |
| 4,042,032 | 8/1977 | Anderson et al. | 166/276 |
| 4,070,865 | 1/1978 | McLaughlin | 61/36 C |
| 4,428,436 | 1/1984 | Johnson | 172/372 |
| 4,829,100 | 5/1989 | Murphey | 523/131 |
| 4,945,991 | 8/1990 | Jones et al. | 166/278 |
| 5,058,676 | 10/1991 | Fitzpatrick | 166/278 |
| 5,082,052 | 1/1992 | Jones et al. | 166/51 |
| 5,113,935 | 5/1992 | Jones et al. | 166/51 |
| 5,128,390 | 7/1992 | Murphey | 523/130 |
| 5,161,613 | 11/1992 | Jones | 166/242 |
| 5,161,618 | 11/1992 | Jones et al. | 166/308 |
| 5,333,688 | 8/1994 | Jones et al. | 166/278 |
| 5,417,284 | 5/1995 | Jones | 166/280 |
| 5,419,394 | 5/1995 | Jones | 166/51 |
| 5,435,391 | 7/1995 | Jones | 166/308 |
| 5,515,915 | 5/1996 | Jones et al. | 166/51 |
| 5,560,427 | 10/1996 | Jones | 166/280 |
| 5,588,487 | 12/1996 | Bryant | 166/51 |
| 5,609,207 | 3/1997 | Dewprashad et al. | 166/276 |

FOREIGN PATENT DOCUMENTS

| | | |
|---|---|---|
| 2 316 967 | 3/1998 | United Kingdom . |
| 2 317630 | 4/1998 | United Kingdom . |
| WO 93/04267 | 3/1993 | WIPO . |
| WO 93/22536 | 11/1993 | WIPO . |
| WO 94/16194 | 7/1994 | WIPO . |
| WO 95/14844 | 6/1995 | WIPO . |

*Primary Examiner*—William Neuder
*Assistant Examiner*—John Kreck
*Attorney, Agent, or Firm*—Robert A. Kent

[57] ABSTRACT

Improved methods of completing unconsolidated subterranean zones penetrated by wellbores are provided. The methods basically comprise the steps of placing a slotted liner in the zone, isolating the slotted liner and the wellbore in the zone, injecting a hardenable resin composition coated particulate material into the zone by way of the slotted liner and then causing the hardenable resin composition to harden whereby the particulate material is consolidated into a hard permeable uniform mass.

19 Claims, 2 Drawing Sheets

METHODS OF COMPLETING WELLS IN UNCONSOLIDATED SUBTERRANEAN ZONES

BACKGROUND OF THE INVENTION

1. Field of the Invention

The present invention relates to improved methods of completing wells in unconsolidated subterranean zones, and more particularly, to improved methods of completing such wells whereby the migration of fines and sand with the fluids produced therefrom is prevented.

2. Description of the Prior Art

Oil and gas wells are often completed in unconsolidated formations containing loose and incompetent fines and sand which migrate with fluids produced by the wells. The presence of formation fines and sand in the produced fluids is disadvantageous and undesirable in that the particles abrade pumping and other producing equipment and reduce the fluid production capabilities of the producing zones in the wells.

Heretofore, unconsolidated subterranean zones have been stimulated by creating fractures in the zones and depositing particulate proppant material in the fractures to maintain them in open positions. In addition, the proppant has heretofore been consolidated within the fractures into hard permeable masses to reduce the potential of proppant flowback and migration of formation fines and sands through the fractures with produced fluids. Further, costly gravel packs which include sand screens and the like have commonly been installed in the wellbores penetrating unconsolidated zones. The gravel packs serve as filters and help to assure that fines and sand do not migrate with produced fluids into the wellbores.

In a typical gravel pack completion, a screen is placed in the wellbore and positioned within the unconsolidated subterranean zone which is to be completed. The screen is typically connected to a tool which includes a production packer and a cross-over, and the tool is in turn connected to a work or production string. A particulate material which is usually graded sand, often referred to in the art as gravel, is pumped in a slurry down the work or production string and through the cross over whereby it flows into the annulus between the screen and the wellbore. The liquid forming the slurry leaks off into the subterranean zone and/or through the screen which is sized to prevent the sand in the slurry from flowing there-through. As a result, the sand is deposited in the annulus around the screen whereby it forms a gravel pack. The size of the sand in the gravel pack is selected such that it prevents formation fines and sand from flowing into the wellbore with produced fluids.

A problem which is often encountered in forming gravel packs, particularly gravel packs in long and/or deviated unconsolidated producing intervals, is the formation of sand bridges in the annulus. That is, non-uniform sand packing of the annulus between the screen and the wellbore often occurs as a result of the loss of carrier liquid from the sand slurry into high permeability portions of the subterranean zone which in turn causes the formation of sand bridges in the annulus before all the sand has been placed. The sand bridges block further flow of the slurry through the annulus which leaves voids below the bridges formed. When the well is placed on production, the flow of produced fluids is concentrated through the voids in the gravel pack which soon causes the screen to be eroded and the migration of fines and sand with the produced fluids to result.

In attempts to prevent the formation of sand bridges in gravel pack completions, special screens having internal bypass tubes have been developed and used. While such screens have achieved varying degrees of success in avoiding sand bridges, they, along with the gravel packing procedure, are very costly.

Thus, there are needs for improved methods of completing wells in unconsolidated subterranean zones whereby the migration of formation fines and sand with produced fluids can be economically and permanently prevented while allowing the efficient production of hydrocarbons from the unconsolidated producing zone.

SUMMARY OF THE INVENTION

The present invention provides improved methods of completing wells, and optionally simultaneously fracture stimulating the wells, in unconsolidated subterranean zones which meet the needs described above and overcome the deficiencies of the prior art. The improved methods basically comprise the steps of placing a slotted liner in an unconsolidated subterranean zone, isolating the annulus between the slotted liner and the wellbore in the zone, injecting a hardenable resin composition coated particulate material into the zone by way of the slotted liner whereby the particulate material is uniformly packed into the annulus and into the slotted liner, and then causing the hardenable resin composition to harden whereby the particulate material is consolidated into a uniform hard permeable mass. The hard permeable mass formed in the annulus prevents the migration of formation fines and sand with fluids produced into the wellbore from the unconsolidated zone.

As mentioned, the unconsolidated formation can be fractured prior to or during the injection of the hardenable resin composition coated particulate material into the unconsolidated producing zone, and the resin composition coated particulate material can be deposited in the fractures as well as in the annulus between the slotted liner and the wellbore. The hard permeable mass of particulate material remaining in the slotted liner can be left in the liner or drilled out of the liner as desired.

The improved methods of this invention avoid the formation of sand bridges in the annulus between the slotted liner and the wellbore thereby producing a very effective sand screen for preventing the flowback of proppant that has been placed in the fracture, and the migration of fines and sand with produced fluids. Also, the methods are very economical to perform.

It is, therefore, a general object of the present invention to provide improved methods of completing wells in unconsolidated subterranean zones.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

The present invention provides improved methods of completing and optionally simultaneously fracture stimulating an unconsolidated subterranean zone penetrated by a wellbore. The methods can be performed in either vertical or horizontal wellbores which are open-hole or have casing cemented therein. The term "vertical wellbore" is used herein to mean the portion of a wellbore in an unconsolidated subterranean producing zone to be completed which is substantially vertical or deviated from vertical in an amount up to about 15°.

The term "horizontal wellbore" is used herein to mean the portion of a wellbore in an unconsolidated subterranean producing zone to be completed which is substantially horizontal or at an angle from vertical in the range of from about 60° to about 120°.

Figure 3:
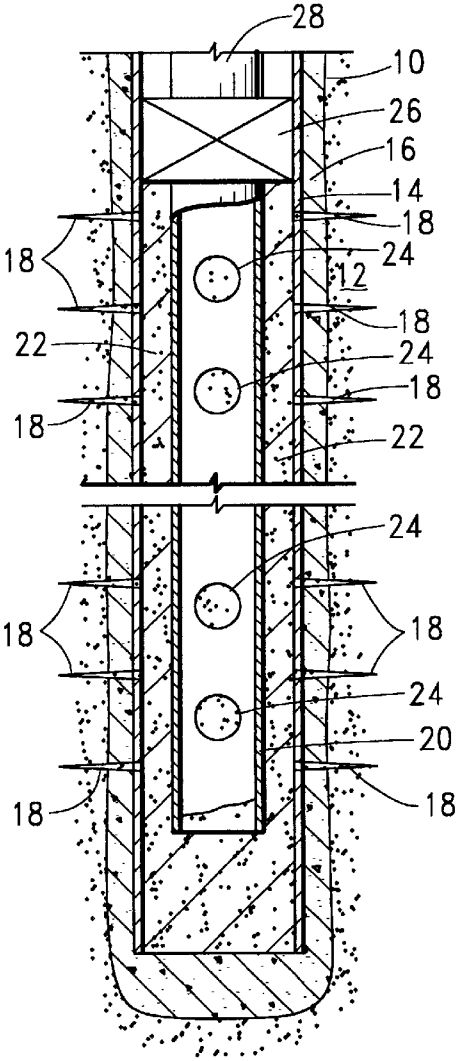
FIG. 3 is a side cross sectional view of the wellbore of FIG. 1 after the hardened resin composition coated particulate material has been drilled out of the slotted liner.
Figure 2:
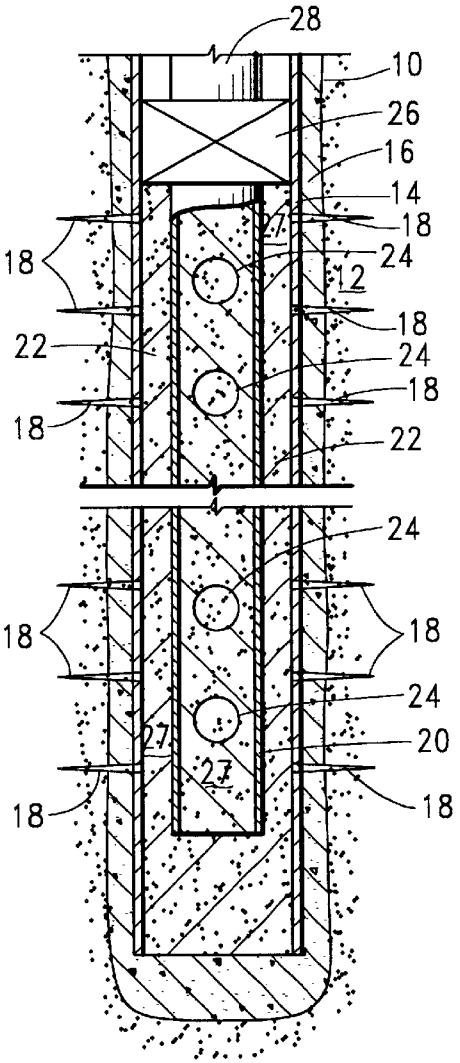
FIG. 2 is a side cross-sectional view of the wellbore of FIG. 1 after a hardenable resin composition coated particulate material has been placed therein and caused to harden.
Figure 1:
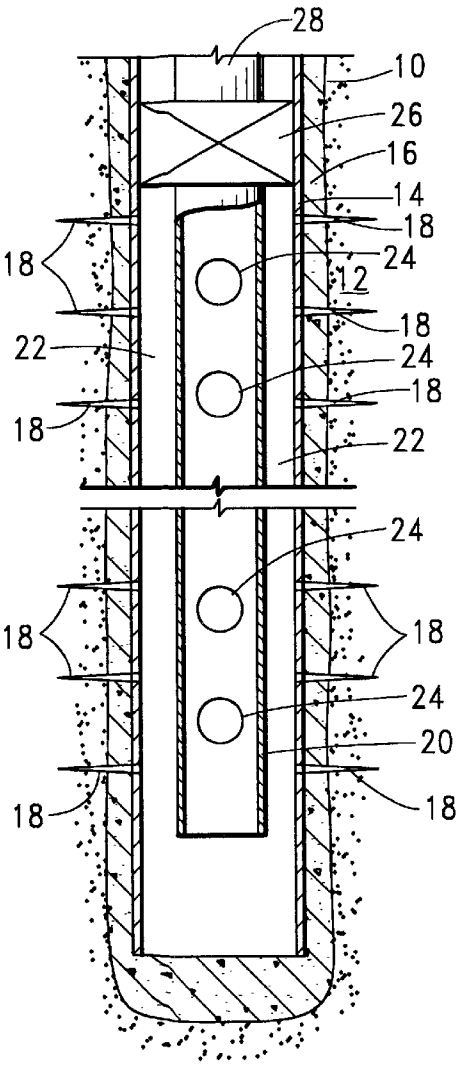
FIG. 1 is a side cross-sectional view of a wellbore penetrating an unconsolidated subterranean producing zone having casing cemented therein and having a slotted liner and production packer connected to a work or production string disposed therein.

Referring now to the drawings and particularly to FIGS. 1–3, a vertical wellbore 10 having casing 14 cemented therein is illustrated extending into an unconsolidated subterranean zone 12. The casing 14 is bonded within the wellbore 10 by a cement sheath 16. A plurality of spaced perforations 18 produced in the wellbore 10 utilizing conventional perforating gun apparatus extend through the casing 14 and cement sheath 16 into the unconsolidated producing zone 12.

In accordance with the methods of the present invention a slotted liner 20 is placed in the wellbore 10 which has a length such that it substantially spans the length of the producing interval in the wellbore 10. The slotted liner 20 is of a diameter such that when it is disposed within the wellbore 10 an annulus 22 is formed between it and the casing 14. The slots 24 in the slotted liner 20 can be circular as illustrated in the drawings, or they can be rectangular or other shape. Generally, when circular slots are utilized they are at least ⅜" in diameter, and when rectangular slots are utilized they are at least ¼" wide by 1" long. As shown in FIGS. 1–3, the slotted liner 20 is connected to a production packer 26 which is in turn connected to a work string or production string 28.

After the slotted liner 20 is placed in the wellbore 10, the annulus 22 between it and the casing 14 is isolated by setting the packer 26 in the casing 14 as shown in FIG. 1. Thereafter, as shown in FIG. 2, a hardenable resin composition coated particulate material 27 which will be described further hereinbelow is injected into the perforations 18 and into the annulus 22 by way of the work or production string 28 and the slotted liner 20. That is, a carrier liquid slurry of the hardenable resin composition coated particulate material 27 is pumped from the surface through the work or production string 28 and packer 26 into the slotted liner 20. From the slotted liner 20, the slurry flows through the slots 24 and through the open end of the slotted liner 20, into the annulus 22 and into the perforations 18. The carrier liquid in the slurry leaks off through the perforations 18 into the unconsolidated zone 12 causing the hardenable resin composition coated particulate material 27 to be uniformly packed in the perforations 18, in the annulus 22 between the slotted liner 20 and the casing 14 and within the interior of the slotted liner 14.

After the resin composition coated particulate material 27 has been packed into the wellbore 10 as described above, the hardenable resin composition is caused to harden by allowing it to be heated in the wellbore 10 by heat from the subterranean zone 12 or by contacting it with a hardening agent as will be described further hereinbelow. When the hardenable resin composition hardens, it consolidates the particulate material 27 into a hard permeable uniform mass which filters out and prevents the migration of formation fines and sand with fluids produced into the wellbore from the unconsolidated subterranean zone 12. As shown in FIG. 3, the consolidated particulate material 27 can be drilled out of the slotted liner 20 if a pump is to be installed in the slotted liner or for other reasons.

Figure 4:
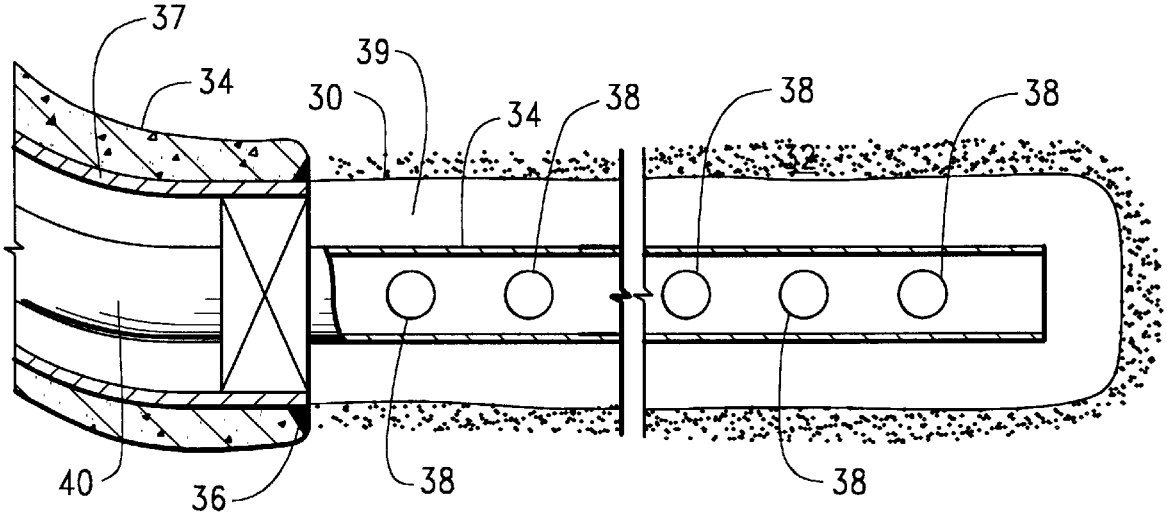
FIG. 4 is a side cross sectional view of a horizontal open-hole wellbore penetrating an unconsolidated subterranean producing zone having a slotted liner and a production packer connected to a work or production string disposed therein.
Figure 5:
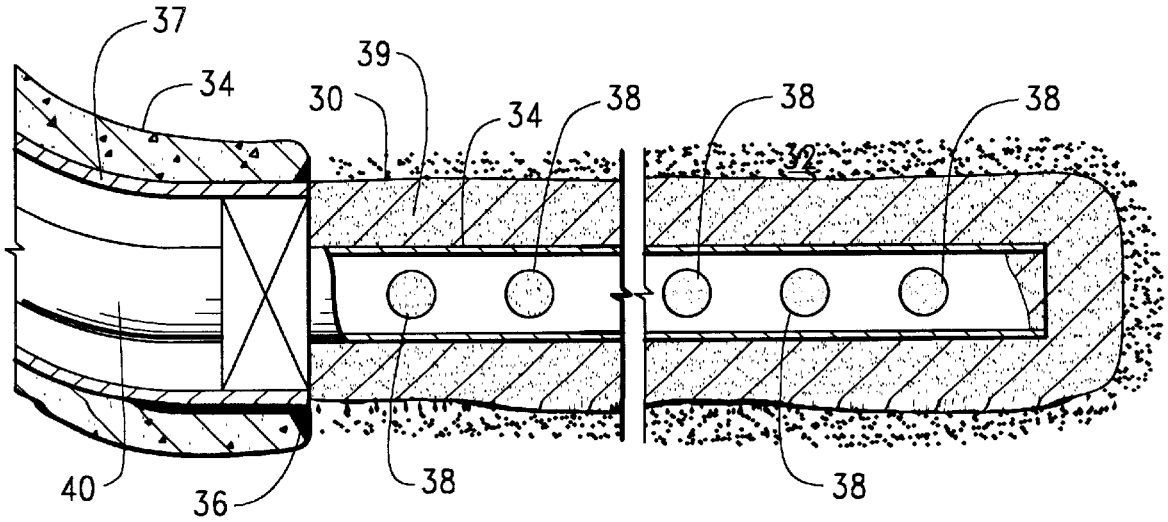
FIG. 5 is a side cross sectional view of the horizontal open hole wellbore of FIG. 4 after a hardenable resin composition coated particulate material has been placed in the annulus between the slotted liner and the wellbore and caused to harden therein and hardened resin composition particulate material has been drilled out of the slotted liner.

Referring now to FIGS. 4 and 5, a horizontal open-hole wellbore 30 is illustrated. The wellbore 30 extends into an unconsolidated subterranean zone 32 from a cased and cemented wellbore 34 which extends to the surface. As described above in connection with the wellbore 10, a slotted liner 34 is placed in the wellbore 30. The slotted liner 34 is connected to a production packer 36 set within the casing 37 cemented in the wellbore 34. A work or production string 40 is connected to the packer 36.

In carrying out the methods of the present invention for completing the unconsolidated subterranean zone 32 penetrated by the wellbore 30, the slotted liner 34 is placed in the wellbore 30 as shown in FIG. 4. The annulus 39 between the slotted liner 34 and the wellbore 30 is isolated by setting the packer 36. Thereafter, a slurry of hardenable resin composition coated particulate material is injected into the wellbore 30 and subterranean zone 32 by way of the slotted liner 34 and the slots 38 therein. Because the resin coated particulate material slurry is free to flow through the slots 38 as well as the open end of the slotted liner 34, the resin coated particulate material 40 is uniformly packed into the annulus 36 between the wellbore 30 and slotted liner 34 as shown in FIG. 5. The hardenable resin composition is then caused to harden whereby the particulate material 40 is consolidated into a uniform hard permeable mass which filters out and prevents the migration of formation fines and sand with fluids produced into the wellbore 30 from the subterranean zone 32. As shown in FIG. 5, the consolidated particulate material can be drilled out of the interior of the slotted liner if desired.

It is to be understood that in view of the present invention the presence of a screen in the wellbore generally is unnecessary to prevent the movement of proppant or formation materials into the wellbore; however, a screen may be positioned within the slotted liner, if desired. In this instance the uncoated particulate or the resin coated particulate slurry is introduced as described hereinbefore to fill the annulus and the space between the screen and the slotted liner as well as between the slotted liner and the casing or the open hole wellbore. Upon consolidation of the resin coated particulate, the particulate forms a uniform hard permeable mass around the screen and slotted liner which filters proppant and formation materials from fluids produced through the wellbore.

It also is possible to perform a remedial treatment upon a wellbore containing a previously installed screen that has been damaged or has failed to prevent undesired particulates from entering the wellbore with produced fluids. In this instance, the installed screen is perforated or slotted by introduction of a perforating gun or hydrojetting tool of conventional design to create openings in the preexisting screen such that it may then function like the slotted liner described hereinbefore. A slurry of resin coated particulate then is introduced down the wellbore through an appropriate tool string to enter the now slotted or perforated screen, flow through the slots and fill uniformly any open annulus and the interior of the preexisting screen. The resin coated particulate then is permitted or caused to harden into a uniform hard permeable mass that filters out and prevents the migration of particulate formation materials or proppant with fluids produced into the wellbore from the subterranean formation. The consolidated particulate material can be drilled out of the interior of the slotted or perforated screen if desired.

The particulate material utilized in accordance with the present invention is preferably graded sand which is sized based on a knowledge of the size of the formation fines and sand in the unconsolidated zone to prevent the formation fines and sand from passing through the consolidated permeable sand mass formed. The sand generally has a particle size in the range of from about 10 to about 70 mesh, U.S. Sieve Series. Preferred sand particle size distribution ranges are 1 or more of 10–20 mesh, 20–40 mesh, 40–60 mesh or 50–70 mesh, depending on the particle size and distribution of the formation fines and sand to be screened out by the particulate material.

The graded sand can be pre-coated and mixed with a carrier liquid to form a slurry on site or the graded sand can be both coated and slurried on site. The hardenable resin compositions which are useful for coating sand and consolidating it into a hard permeable mass are generally comprised of a hardenable organic resin and a resin-to-sand coupling agent. Such resin compositions are well known to those skilled in the art as is their use for consolidating sand into hard permeable masses. A number of such compositions are described in detail in U.S. Pat. No. 4,042,032 issued to Anderson, et al. on Aug. 16, 1977, U.S. Pat. No. 4,070,865 issued to McLaughlin on Jan. 31, 1978, U.S. Pat. No. 4,829,100 issued to Murphey, et al. on May 9, 1989, U.S. Pat. No. 5,058,676 issued to Fitzpatrick, et al. on Oct. 22, 1991 and U.S. Pat. No. 5,128,390 issued to Murphey, et al. on Jul. 7, 1992, all of which are incorporated herein by reference.

Examples of hardenable organic resins which are particularly suitable for use in accordance with this invention are novolac resins, polyepoxide resins, polyester resins, phenol-aldehyde resins, urea-aldehyde resins, furan resins and urethane resins. These resins are available at various viscosities depending upon the molecular weights of the resins. The preferred viscosity of the organic resin used is generally in the range of from about 1 to about 1000 centipoises at 80° F. However, as will be understood, resins of higher viscosities can be utilized when mixed or blended with one or more diluents. Diluents which are generally useful with all of the various resins mentioned above include phenols, formaldehydes, furfuryl alcohol and furfural.

The resin-to-sand coupling agent is utilized in the hardenable resin compositions to promote coupling or adhesion to sand or other similar particulate materials. Particularly suitable coupling agents are aminosilane compounds or mixtures of such compounds. A preferred such coupling agent is N-Beta-(aminoethyl)-gamma-aminopropyltrimethoxysilane.

As mentioned, the hardenable resin composition used is caused to harden by allowing it to be heated in the formation or by contacting it with a hardening agent. When a hardening agent is utilized, it can be included in the resin composition (internal hardening agent) or the resin composition can be contacted with the hardening agent after the resin composition coated particulate material has been placed in the subterranean formation being completed (external hardening agent). An internal hardening agent is selected for use that causes the resin composition to harden after a period of time sufficient for the resin composition coated particulate material to be placed in the subterranean zone to be completed. Retarders or accelerators to lengthen or shorten the cure times can also be utilized. When an external hardening agent is used, the hardenable resin composition coated particulate material is first placed in a zone followed by an over-flush solution containing the external hardening agent. Examples of suitable internal hardening agents which can be used include hexachloroacetone, 1,1,3-trichlorotrifluoroacetone, benzotrichloride, benzylchloride and benzalchloride. Examples of external hardening agents which can be used include benzotrichloride, acetic acid, formic acid and inorganic acids such as hydrochloric acid. The hardenable resin compositions can also include surfactants, dispersants and other additives which are well known to those skilled in the art.

The resin coated particulate material used in accordance with this invention can be prepared in accordance with conventional batch mixing techniques followed by the suspension of the resin coated particulate material in a viscous carrier liquid. Alternatively, the carrier liquid containing hardenable resin composition coated particulate material can be prepared in a substantially continuous manner such as in accordance with the methods disclosed in U.S. Pat. No. 4,829,100 issued to Murphey, et al. on May 9, 1989 or U.S. Pat. No. 5,128,390 issued to Murphey, et al, on Jul. 7, 1992.

The carrier liquid utilized, which can also be used to fracture the unconsolidated subterranean zone if desired, can be any of the various viscous carrier liquids or fracturing fluids utilized heretofore including gelled water, oil base liquids, foams or emulsions. The foams utilized have generally been comprised of water based liquids containing one or more foaming agents foamed with a gas such as nitrogen. The emulsions have been formed with two or more immiscible liquids. A particularly useful emulsion is comprised of a water based liquid and a liquified normally gaseous fluid such as carbon dioxide. Upon pressure release, the liquified gaseous fluid vaporizes and rapidly flows out of the formation.

The most common carrier liquid/fracturing fluid utilized heretofore which is also preferred for use in accordance with this invention is comprised of an aqueous liquid such as fresh water or salt water combined with a gelling agent for increasing the viscosity of the liquid. The increased viscosity reduces fluid loss and allows the carrier liquid to transport significant concentrations of hardenable resin composition coated particulate material into the subterranean zone to be completed.

A variety of gelling agents have been utilized including hydratable polymers which contain one or more functional groups such as hydroxyl, cis-hydroxyl, carboxyl, sulfate, sulfonate, amino or amide. Particularly useful such polymers are polysaccharides and derivatives thereof which contain one or more of the monosaccharides units galactose, mannose, glucoside, glucose, xylose, arabinose, fructose, glucuronic acid or pyranosyl sulfate. Various natural hydratable polymers contain the foregoing functional groups and units including guar gum and derivatives thereof, cellulose and derivatives thereof, and the like. Hydratable synthetic polymers and co-polymers which contain the above mentioned functional groups can also be utilized including polyacrylate, polymethylacrylate, polyacrylamide, and the like.

Particularly preferred hydratable polymers which yield high viscosities upon hydration at relatively low concentrations are guar gum and guar derivatives such as hydroxypropylguar and carboxymethylguar and cellulose derivatives such as hydroxyethylcellulose, carboxymethylcellulose and the like.

The viscosities of aqueous polymer solutions of the types described above can be increased by combining cross-linking agents with the polymer solutions. Examples of cross-linking agents which can be utilized are multivalent metal salts or compounds which are capable of releasing such metal ions in an aqueous solution.

The above described gelled or gelled and cross-linked carrier liquids/fracturing fluids can also include gel breakers such as those of the enzyme type, the oxidizing type or the acid buffer type which are well known to those skilled in the art. The gel breakers cause the viscous carrier liquids/fracturing fluids to revert to thin fluids that can be produced back to the surface after they have been utilized.

The creation of one or more fractures in the unconsolidated subterranean zone to be completed in order to stimulate the production of hydrocarbons therefrom is well known to those skilled in the art. The hydraulic fracturing process generally involves pumping a viscous liquid containing suspended particulate material into the formation or zone at a rate and pressure whereby fractures are created therein. The continued pumping of the fracturing fluid extends the fractures in the zone and carries the particulate material into the fractures. Upon the reduction of the flow of the fracturing fluid and the reduction of pressure exerted on the zone, the particulate material is deposited in the fractures and the fractures are prevented from closing by the presence of the particulate material therein.

As mentioned, the subterranean zone to be completed can be fractured prior to or during the injection of the resin composition coated particulate material into the zone, i.e., the pumping of the carrier liquid containing the resin coated particulate material through the slotted liner into the zone. Upon the creation of one or more fractures, the resin coated particulate material can be pumped into the fractures as well as into the annulus between the slotted liner and the wellbore. Upon the hardening of the resin composition, the consolidated particulate material in the fractures functions to prop the fractures open as well as to screen out loose or incompetent formation fines and sand.

In order to further illustrate the methods of this invention, the following example is given.

EXAMPLE

Flow tests were performed to verify the packing performance of this invention in the annulus between a simulated wellbore and a slotted liner. The test apparatus was comprised of a 5' long by 2" diameter plastic tubing for simulating a wellbore. Ten equally spaced ⅝" diameter holes were drilled in the tubing along the length thereof to simulate perforations in a wellbore. A screen was placed inside the tubing over the ⅝ " holes in order to retain sand introduced into the tubing therein. No back pressure was held on the tubing so as to simulate an unconsolidated high permeability formation.

A section of ⅝" ID plastic tubing was perforated with multiple holes of ⅜" to ½" diameters to simulate a slotted liner. The ⅝" tubing was placed inside the 2" tubing without centralization. Flow tests were performed with the apparatus in both the vertical and horizontal positions.

In one flow test, an 8 pounds per gallon slurry of 20/40 mesh sand was pumped into the ⅝" tubing. The carrier liquid utilized was a viscous aqueous solution of hydrated hydroxypropylguar (at a 60 pound per 1000 gallon concentration). The sand slurry was pumped into the test apparatus with a positive displacement pump. Despite the formation of sand bridges at the high leak off areas (at the perforations), alternate paths were provided through the slotted tubing to provide a complete sand pack in the annulus.

In another flow test, a slurry containing two pounds per gallon of 20/40 mesh sand was pumped into the ⅝" tubing. The carrier liquid utilized was a viscous aqueous solution of hydrated hydroxypropylguar (at a concentration of 30 pounds per 1000 gallon). Sand bridges were formed at each perforation, but the slurry was still able to transport sand into the annulus and a complete sand pack was produced therein.

In another flow test, a slurry containing two pounds per gallon of 20/40 mesh sand was pumped into the test apparatus. The carrier liquid was a viscous aqueous solution of hydrated hydroxypropylguar (at a 45 pound per 1000 gallon concentration). In spite of sand bridges being formed at the perforations, a complete sand pack was produced in the annulus.

Thus, the present invention is well adapted to carry out the objects and attain the ends and advantages mentioned as well as those which are inherent therein. While numerous changes may be made by those skilled in the art, such changes are included in the spirit of this invention as defined by the appended claims.

What is claimed is:

1. An improved method of completing an unconsolidated subterranean zone penetrated by a wellbore having an upper and lower end comprising the steps of:

(a) placing a slotted liner in a lower end of said wellbore in said zone;

(b) isolating the annulus between said slotted liner and said lower end of said wellbore in said zone from said upper wellbore end;

(c) injecting a hardenable resin composition coated particulate material into said lower end of said wellbore in said zone by way of said slotted liner whereby said particulate material is uniformly packed into said annulus and into said slotted liner;

(d) causing said hardenable resin composition to harden whereby said particulate material is consolidated into a hard permeable uniform mass capable of preventing migration of at least a portion of any unconsolidated formation fines and sand with fluids produced into said wellbore from said zone; and (e) drilling at least a portion of the hard permeable mass of particulate material formed in accordance with step (d) out of the interior of said slotted liner.

2. The method of claim 1 wherein said particulate material is sand.

3. The method of claim 1 wherein said wellbore in said subterranean zone is open-hole.

4. The method of claim 1 wherein said wellbore in said subterranean zone has casing cemented therein with perforations formed through the casing and cement.

5. The method of claim 1 which further comprises the step of creating at least one fracture in said subterranean zone prior to or while carrying out step (c).

6. An improved method of completing an unconsolidated subterranean zone penetrated by an open-hole wellbore having an upper and lower end comprising the steps of:

(a) placing a slotted liner in a lower end of said wellbore in said zone;

(b) isolating the annulus between said slotted liner and said lower end of said wellbore in said zone from said upper wellbore end;

(c) pumping a slurry of a hardenable resin composition coated particulate material into said lower end of said wellbore in said zone by way of said slotted liner whereby said particulate material is uniformly packed into said annulus and into said slotted liner;

(d) causing said hardenable resin composition to harden whereby said particulate material is consolidated into a hard permeable uniform mass capable of preventing migration of at least a portion of any unconsolidated formation fines and sand with fluids produced into said wellbore from said zone; and (e) drilling said hard permeable mass of particulate material out of said slotted liner.

7. The method of claim 6 wherein said annulus between said slotted liner and said wellbore is isolated in accordance with step (b) by setting a production packer in said wellbore sealingly attached to said slotted liner.

8. The method of claim 6 wherein said wellbore in said zone is horizontal.

9. The method of claim 6 which further comprises the step of creating at least one fracture in said subterranean zone prior to or while carrying out step (c).

10. The method of claim 6 wherein said hardenable resin composition is comprised of an organic resin selected from the group of novolak resins, polyepoxide resins, polyester resins, phenol-aldehyde resins, urea-aldehyde resins, furan resins and urethane resins.

11. The method of claim 6 wherein said hardenable resin composition is caused to harden in accordance with step (d) by being heated in said subterranean zone.

12. The method of claim 6 wherein said hardenable resin composition is caused to harden in accordance with step (d) by being contacted with a hardening agent.

13. An improved method of completing an unconsolidated subterranean zone penetrated by a wellbore having casing cemented therein and having an upper and lower end comprising the steps of:

(a) forming perforations through said casing and cement into said zone;

(b) placing a slotted liner in a lower end of said wellbore in said zone;

(c) isolating the annulus between said slotted liner and said lower end of said wellbore in said zone from said upper wellbore end;

(d) pumping a slurry of a hardenable resin composition coated particulate material into said zone by way of said slotted liner whereby said particulate material is uniformly packed into said perforations, said annulus and said slotted liner;

(e) causing said hardenable resin composition to harden whereby said particulate material is consolidated into a hard permeable uniform mass capable of preventing migration of at least a portion of any unconsolidated formation fines and sand with fluids produced into said wellbore from said zone; and (f) drilling at least a portion of the hard permeable mass of particulate material formed in accordance with step (e) out of the interior of said slotted liner.

14. The method of claim 13 wherein said wellbore in said zone is horizontal.

15. The method of claim 13 which further comprises the step of creating at least one fracture in said subterranean zone prior to or while carrying out step (d).

16. The method of claim 13 wherein said hardenable resin composition is comprised of an organic resin selected from the group of novolak resins, polyepoxide resins, polyester resins, phenol-aldehyde resins, urea-aldehyde resins, furan resins and urethane resins.

17. The method of claim 13 wherein said hardenable resin composition is caused to harden in accordance with step (e) by being heated in said subterranean zone.

18. The method of claim 13 wherein said hardenable resin composition is caused to harden in accordance with step (e) by being contacted with a hardening agent.

19. An improved method of recompleting an unconsolidated subterranean zone penetrated by a wellbore having an upper and lower end having a screen positioned therein in said lower end comprising the steps of:

(a) forming perforations or slots through said screen to effect communication with the annulus surrounding said screen in said lower wellbore end;

(b) isolating the annulus between said perforated screen and said lower end of said wellbore from said upper wellbore end;

(c) pumping a slurry of a hardenable resin composition coated particulate material into said lower wellbore end by way of said perforated screen whereby said particulate material is uniformly packed into said perforations, said annulus and said slotted liner;

(d) causing said hardenable resin composition to harden whereby said particulate material is consolidated into a hard permeable uniform mass capable of preventing migration of at least a portion of any unconsolidated formation particulates with fluids produced into said wellbore.

* * * * *